US005572559A

United States Patent [19]

Smith et al.

[11] Patent Number: 5,572,559

[45] Date of Patent: Nov. 5, 1996

[54] RADIOGRAPHY APPARATUS USING GAMMA RAYS EMITTED BY WATER ACTIVATED BY FUSION NEUTRONS

[75] Inventors: Donald L. Smith, Plainfield, Ill.; Yujiro Ikeda; Yoshitomo Uno, both of Ibaraki, Japan

[73] Assignee: The United States of America as represented by the United States Department of Energy, Washington, D.C.

[21] Appl. No.: 583,150

[22] Filed: Dec. 28, 1995

[51] Int. Cl.[6] ..... G21G 1/06

[52] U.S. Cl. ..... 376/159; 378/120; 378/53

[58] Field of Search ..... 376/159; 250/390.02; 378/53–56, 120

[56] References Cited

U.S. PATENT DOCUMENTS

| | | | |
|---|---|---|---|
| 2,302,470 | 11/1942 | Pecher | 250/65 |
| 3,955,086 | 5/1976 | Tsujii et al. | 250/358 R |
| 4,232,224 | 11/1980 | Graham et al. | 250/356 |
| 4,365,154 | 12/1982 | Arnold et al. | 250/270 |
| 5,219,518 | 6/1993 | McKeon et al. | 376/159 |

OTHER PUBLICATIONS

Materials Evaluation, May 1966, pp. 249–252, Green et al.
Proceedings of the 8th International Conference on Radiation Shielding–Satoshi Sato–Evaluation of Skyshine Dose Rate due to Gamma–Rays from Activated Cooling Water in fusion experimental Reactors–pp. 946–953.

*Primary Examiner*—Harvey E. Behrend
*Attorney, Agent, or Firm*—Bradley W. Smith; Hugh Glenn; William R. Moser

[57] ABSTRACT

Radiography apparatus includes an arrangement for circulating pure water continuously between a location adjacent a source of energetic neutrons, such as a tritium target irradiated by a deuteron beam, and a remote location where radiographic analysis is conducted. Oxygen in the pure water is activated via the $^{16}O(n,p)^{16}N$ reaction using $^{14}$-MeV neutrons produced at the neutron source via the $^{3}H(d,n)^{4}He$ reaction. Essentially monoenergetic gamma rays at 6.129 (predominantly) and 7.115 MeV are produced by the 7.13-second $^{16}N$ decay for use in radiographic analysis. The gamma rays have substantial penetrating power and are useful in determining the thickness of materials and elemental compositions, particularly for metals and high-atomic number materials. The characteristic decay half life of 7.13 seconds of the activated oxygen is sufficient to permit gamma ray generation at a remote location where the activated water is transported, while not presenting a chemical or radioactivity hazard because the radioactivity falls to negligible levels after 1–2 minutes.

19 Claims, 9 Drawing Sheets

RADIOGRAPHY APPARATUS USING GAMMA RAYS EMITTED BY WATER ACTIVATED BY FUSION NEUTRONS

CONTRACTUAL ORIGIN OF THE INVENTION

The United States Government has rights in this invention pursuant to Contract No. W-31-109-ENG-38 between the U.S. Department of Energy (DOE) and the University of Chicago representing Argonne National Laboratory.

FIELD OF THE INVENTION

This invention relates to a method and apparatus for performing radiography with high energy photons generated by activating water with 14-MeV deuterium-tritium (D-T) fusion neutrons via the $^{16}O(n,p)^{16}N$ reaction followed by the decay of $^{16}N$. More specifically, this invention involves a method and apparatus for studying thick dense objects which are not easily studied with lower energy X-rays or neutrons and which is capable of providing detailed information regarding the structure and composition of the object including the identification of such features as hidden holes and discontinuities in atomic number.

BACKGROUND OF THE INVENTION

The concept of using penetrating photons to examine the interior regions of objects that cannot be observed directly is about 100 years old. The revolutionary discovery of X-rays by Roentgen in 1895 led promptly to the development of non-destructive, non-invasive interrogation techniques applicable to various objects including the human body. Since the time of Roentgen, this method has developed enormously and now finds routine application in practically every aspect of modern life, e.g., manufacturing, construction, quality control, medicine, defense, transportation, security and basic and applied research.

The fundamental principles of photon radiography are well known and widely described in the literature. The most widely used approach involves X-rays in the range of a few keV to several hundred keV that are produced at relatively low cost by electron bombardment of medium to high atomic number metals in sealed, evacuated X-ray tubes. While this approach is extremely versatile, there are limits based on the penetrating capacity of these photons and on attainable source intensities. Photons with higher energies and source intensities can be obtained from radioactive gamma-ray sources, e.g., $^{60}Co$ (or $^{137}Cs$) and from electron accelerators such as linacs and synchrotons. Radioactive sources are difficult to handle and store safely. Also, the range of geometric configurations that are possible with these materials is somewhat limited, mainly due to safety considerations. Accelerator sources are capable of producing very high radiation intensities and relatively high photon energies, but like X-ray tubes, they involve continuous energy photon spectra. These machines are also generally rather costly to build and operate. Because photon transmission through matter is highly energy dependent, radiography with continuous energy sources generally suffers from lack of adequate contrast and the inability to select proper exposure.

The present invention addresses the aforementioned limitations of the prior art by providing a radiographic method and apparatus which provides essentially monoenergetic, variable intensity, highly penetrating photons in an arrangement which is relatively inexpensive, safe and flexible in configuration for various applications.

OBJECTS AND SUMMARY OF THE INVENTION

Accordingly, it is an object of the present invention to provide one or more monoenergetic photon beams for use in the non-destructive, non-invasive analysis and testing of thick dense materials and objects.

It is another object of the present invention to provide a photon source which is monoenergetic, of variable intensity, highly penetrating and is relatively safe and inexpensive to operate.

Yet another object of the present invention is to provide a high energy photon source which employs the deuterium-tritium fusion reactor cooling process and does not present either chemical or radioactivity hazards.

A further object of the present invention is to provide apparatus and method for determining the composition and structure of a solid object requiring only modest resolution, but substantial photon penetrating power and has the capability to contrast varying thicknesses of materials and elemental compositions, particularly for metals and higher atomic number materials.

The present invention contemplates a method and apparatus for performing radiography with the high energy photons generated by activating water with 14-MeV D-T fusion neutrons via the $^{16}O(n,p)^{16}N$ reaction followed by the decay of $^{16}N$. More specifically, this invention involves a method and apparatus for performing scans of thick dense objects using highly monoenergetic photons produced by activating water with energetic neutrons. The apparatus thus includes a neutron source (normally a 14-MeV neutron generator), a sealed tube of rubber or flexible material in the form of a continuous loop, pure water which is placed inside the sealed tube for receiving the neutron radiation; a water pump; a water flow rate meter; a shielding and collimator system for forming the photon beam and a sodium iodide photon detector and associated electronics for detecting photons transmitted through the material or object being investigated; and for subsequently recording the signals. The water is continuously circulated between the region where it is bombarded with neutrons and becomes radioactive and the radiography portion of the system. The specific activity of the water (Curies per milliliter) depends upon the strength of the neutron field, the time the water spends in this field, and the transport time between the field region and the radiography portion of the system. In general, the intensity of the photon emission at the position of the radiography portion of the system depends on the water flow rate, the volume of water, the intensity of the neutron field and various geometrical factors. A portion of the water line is heavily shield, except for a collimator arrangement for forming the photon beam. The sodium iodide detector is also shielded and views the photon source through a similar collimator arrangement. The object or material to be studied by radiography is transported step-by-step through the gap between the photon source and the detector. The data recorded are photon transmissions, i.e., the ratio of incident photons per unit time and transmitted photons per unit time.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
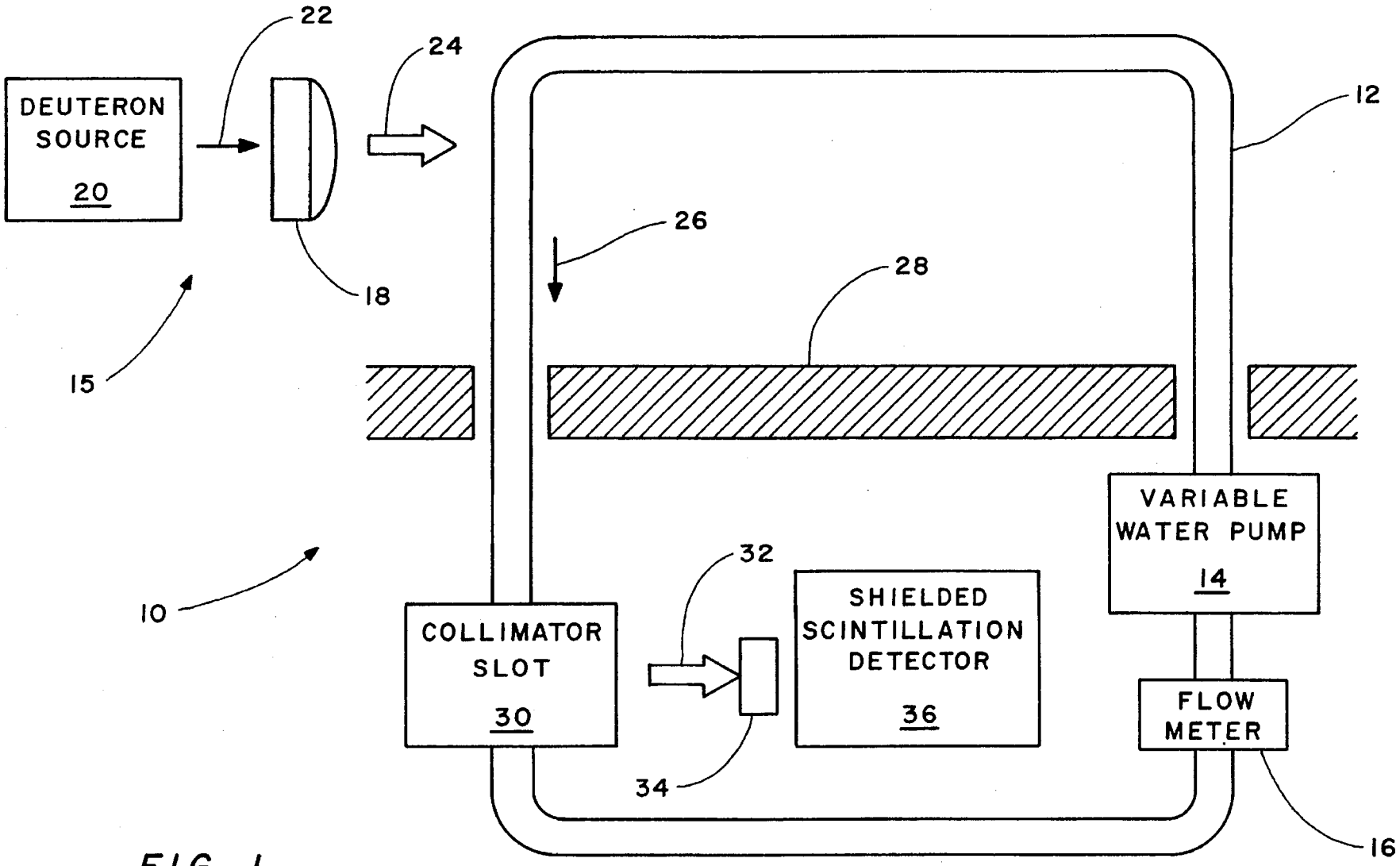
FIG. 1 is a simplified schematic diagram of a radiography apparatus using gamma rays emitted by water activated by fusion neutrons in accordance with the present invention.

The $^{16}O(n,p)^{16}N$ reaction leads to activation of ordinarily benign pure water ($H_2O$) when it is bombarded with sufficiently energetic neutrons. The natural isotopic abundance of $^{16}O$ is 99.76%. The Q-value for this reaction is −9.637 MeV, and that corresponds to a relatively high neutron reaction threshold energy of 10.245 MeV. The reaction cross section is essentially negligible below 11 MeV but increases rapidly to around 80 millibarns near 12 MeV, apparently due to a cross section resonance near threshold. The cross section is around 40–50 millibarns in the range 14–15 MeV. The $^{17}O(n,d+n'p)^{16}N$ $^{18}O(n,t)^{16}N$, $^{16}O(n,\gamma)^{17}O(n,d+n'p)^{16}N$, $^{17}O(n,2n)^{16}O(n,p)^{16}N$ and $^{17}O(n,t)^{15}N(n,\gamma)^{16}N$ reactions also contribute to $^{16}N$ production when pure water is irradiated with 14-MeV neutrons. However, because of low isotopic abundances and small cross sections, these secondary contributions are extremely small. Relative to the $^{16}O(n,p)^{16}N$ reaction, the yield from the one-step secondary reactions is estimated to be less than one part in $10^4$. For the two-step secondary processes the relative yield is estimated to be less than one part in $10^5$, even when it is assumed that the cooling water has been exposed continuously for one year to fusion neutrons at assumed flux levels as high as $10^{15}$ neutrons/cm$^2$/second (roughly corresponding to a fusion power reactor operating at full power). In any event, it does not matter from the perspective of radiography which processes are involved in generating the $^{16}N$ activity.

The decay by beta ($\beta^-$) emission of the product nucleus $^{16}N$ with a 7.13 second half life to $^{16}O$ is a very energetic process. The transition to the ground state of $^{16}O$ involves beta particles with energies up to 10.419 MeV. There are also beta-decay transitions to excited levels of $^{16}O$ followed by gamma-ray emission. The average energy of the composite beta spectrum is 2.693 MeV. Of interest in the present invention is the fact that 68.8% of all decays of $^{16}N$ produce a 6.129-MeV gamma ray while 4.7% produce a 7.115-MeV gamma ray. The 6.129-MeV gamma rays thus outnumber those of 7.115-MeV by nearly 15-to-1. Furthermore, the transmission cross sections for these two energies differ by only a few percent across the Periodic Table. Therefore, water which is activated by sufficiently high energy neutrons becomes a source of nearly monoenergetic high-energy gamma rays which can be used for a variety of purposes. For completeness, it should be noted here that the neutron inelastic scattering reaction, $^{16}O(n,n,)^{16}O$, also leads to the emission of these same gamma rays for neutron energies above the threshold for exciting the specific excited levels in $^{16}O$. The cross section for this process is several hundred millibarns for 14-MeV neutrons. However, the gamma-ray emission is prompt so neutron inelastic scattering from water does not contribute a source of delayed gamma radiation from water which has been transported away from the region in the D-T fusion reactor where the neutron irradiation occurs.

The limiting conversion efficiency for 14-MeV neutrons to 6.129+7.115 MeV photons in an infinite water medium is approximately the ratio of the $^{16}O(n,p)^{16}N$ reaction cross section (40–50 millibarns) to the neutron total cross section for water (about 3 barns) multiplied by the photon-emission branching factor (about 0.74). This amounts to an efficiency of about 1% which is not large but nevertheless leads to significant gamma-ray production when water is exposed to 14-MeV neutron fields such as those produced by a D-T neutron generator or in a D-T fusion reactor. This is clearly evident from the recent calculations by Sato et al. in "Evaluation of Skyshine Dose Rate Due to Gamma-rays from Activated Cooling Water in Fusion Experimental Reactors," p. 946, *Proceedings of the 8th International Conference on Radiation Shielding*, American Nuclear Society, La Grange Park, Ill. (1994) for the ITER (International Thermonuclear Experimental Reactor) conceptual design as discussed below. Although the 14-MeV neutron fields produced by D-T neutron generators are much less intense than those anticipated for D-T fusion devices such as ITER, these accelerators are readily available in many laboratories. It has been possible to demonstrate using the present invention that sufficient numbers of $^{16}N$ gamma rays can be produced with a D-T neutron generator to allow photon radiography to be carried out with moderate resolution. In any event, the present invention will operate with virtually any source of D-T fusion neutrons.

The present invention was carried out at the Fusion Neutron Source (FNS) accelerator located at the Japan Atomic Energy Research Institute (JAERI) in Tokai, Japan. At this D-T neutron generator facility, deuterons can be accelerated up to 350-key energy, with beam currents up to 20 milliamperes. The deuterons impinge upon a titanium-tritide target to produce neutrons via the $^3H(d,n)^4He$ reaction. This arrangement leads to neutron production up to $3\times10^{12}$ neutrons per second (into $4\pi$ steradian). Since the reaction Q-value is 17.591 MeV, the energies of the emitted neutrons are in the range 13–15 MeV, depending upon the angle of emission relative to the incident deuterons. As D-T neutron generators go, this is a very powerful facility. Consequently, it was possible to carry out the present invention without considerations as to the optimization of the geometrical coupling between the neutron source and circulating water that was activated for radiography purposes.

Referring to FIG. 1, there is shown a simplified schematic diagram of a radiography apparatus 10 using gamma rays emitted by water activated by fusion neutrons in accordance with the present invention. The radiography apparatus 10 includes a circulating loop of water 12 comprised of plastic tubing having an inner diameter of approximately 1 cm, a water pump 14 and a flow meter 16. The water within the circulating loop 12 flows in the direction of arrow 26 and through a shielding arrangement 28. The circulating loop of water 12 is arranged in a straight line along a path approximately 10 cm from a point neutron source 15 at its closest approach.

Neutron source 15 includes a source of energetic deuterons 20 such as the aforementioned FNS accelerator for directing 350-keV deuterons represented by arrow 22 onto a titanium-tritide target 18. The deuterons 22 impinging upon the titanium-tritide target 18 produce neutrons represented by arrow 24 via the $^{3}H(d,n)^{4}He$ reaction. This reaction leads to neutron production up to $3\times10^{12}$ neutrons per second (into $4\pi$ steradian).

The flow rates used in the circulating loop 12 could be varied by means of water pump 14 and were measured by means of flow meter 16. The intensity of the photon field could also be adjusted by changing the coupling of the circulating water loop to the neutron radiation field or, more simply by varying the speed of the water pump 14. In the disclosed embodiment, the water flow rate was such that any individual volume element of water spent no more than about 0.1 second in the high-fluence region near the titanium-tritide target 18. Because this time period is much shorter than the $^{16}N$ half life, the activity generated in the water was always far short of saturation. The physical parameters available for optimization of the neutron irradiation configuration are dwell time in the neutron field, solid angle relative to the point neutron source, and average neutron energy. It is estimated that by coiling the water line and placing it closer to the target of the Fusion Neutron Source (FNS) accelerator, it would have been possible to achieve $^{16}N$ concentrations in the flowing water of two orders of magnitude ($10^2$) higher than were actually attained in the present embodiment. A maximum flow rate of about 10 liters per minute (corresponding to about 2 meters per second velocity in the tubing) could be achieved with the water pump 14 utilized in the disclosed embodiment. It was found that this particular flow rate provided nearly the highest possible delivered intensity of $^{16}N$ activity at the position of the radiography apparatus (located approximately 25 meters from the accelerator target) for the particular geometry shown in FIG. 1 the $^{16}N$ activity in the transported water decreased to about 30% of its value near the accelerator target due to radioactive decay during the required transit time of approximately 12 seconds between the titanium-tritide target and the radiographic portion of the apparatus. As indicated below, sufficient $^{16}N$ activity was present at this position to perform the radiography measurements reported below. An estimate was made of the 6.129+7.115 MeV gamma ray emission rate from the water in the circulating loop 12. These calculations were based on physical data discussed above and details of the inventive radiography apparatus 10. The result obtained was approximately $1\times10^4$ photons per second per milliliter of water (i.e., about 0.27 microCuries per milliliter). The actual volume of water viewed by the detector (described below) was about 7.3 milliliters.

Figure 2:
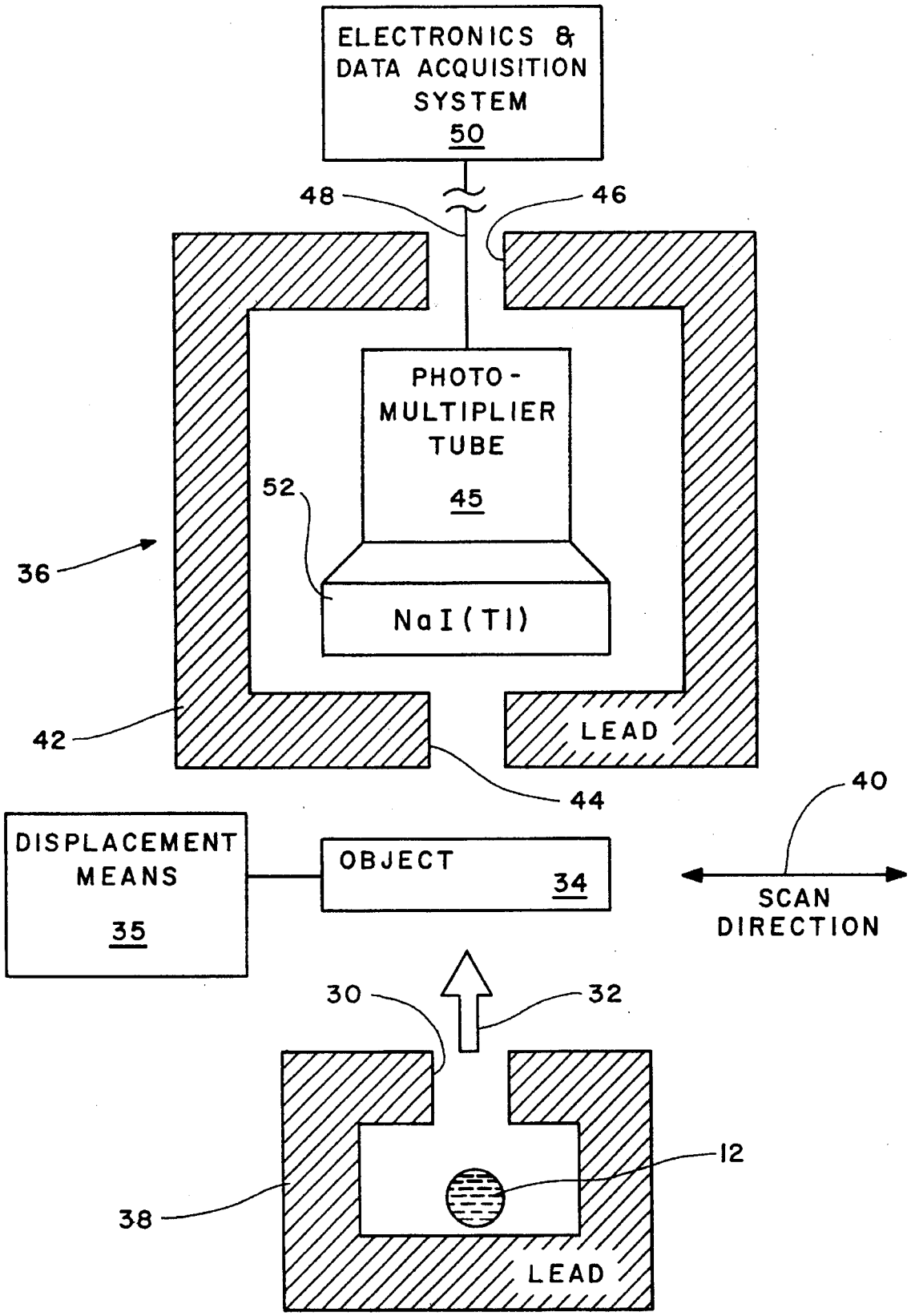
FIG. 2 is a simplified schematic diagram showing details of the circulating water loop and a shielded scintillation detector for use in the radiography apparatus of the present invention.

Referring to FIG. 2, as well as to FIG. 1, details of the photon detection arrangement used in the radiography apparatus 10 will now be described. In the photon detection portion of the radiography apparatus 10, the circulating loop of water 12 is completely surrounded by shielding 38 comprised of lead bricks to a thickness of at least 10 cm, except for a single collimator slot 30 which in the disclosed embodiments is 10 cm wide by 2.5 cm high through which the photons shown in simplified form as arrow 32 in the figures could emerge. A 20 cm gap between the shielded source of photons, i.e., the circulating loop of water 12, and a shielded scintillation detector 36 is provided for placement of an object 34 to be studied by radiography. The shielded scintillation detector 36 includes a 12.7 cm diameter×5.2 cm thick sodium iodide scintillator 52. The sodium iodide scintillator 52 is surrounded by lead shielding 42 at least 10 cm thick, except for a single slot 44 which is 13 cm wide by 2.5 cm high and is aligned with the collimator slot 30 in the shielding 38 of the circulating water loop 12. Table I shows that 10 cm of lead shielding limits the transmission of 6 MeV photons to less than 1%.

TABLE I

| | | Transmission ($I/I_0$) | | | | |
|---|---|---|---|---|---|---|
| Element | x(cm) = | 0.1 | 0.5 | 1.0 | 5.0 | 10.0 |
| Carbon (C) | | 0.9944 | 0.9725 | 0.9457 | 0.7563 | 0.5720 |
| Aluminum (Al) | | 0.9929 | 0.9649 | 0.9309 | 0.6992 | 0.4889 |
| Iron (Fe) | | 0.9763 | 0.8870 | 0.7868 | 0.3015 | 0.0909 |
| Copper (Cu) | | 0.9727 | 0.8706 | 0.7580 | 0.2502 | 0.0626 |
| Lead (Pb) | | 0.9518 | 0.7811 | 0.6102 | 0.0846 | 0.0072 |

A rectangular slot geometry was selected because it provides a greater sensitivity than that available with a cylindrical or square collimator arrangement, without sacrificing resolution in the direction along which object 34 is scanned in the radiography apparatus 10. The rectangular collimator configuration shown in FIG. 2 permits photons to pass through object 34 at various angles. However, in the embodiment of the radiography apparatus shown in FIGS. 1 and 2, the range of angles due to this effect was relatively small, i.e., <14° corresponding to a variation of less than 3% in path length through the object or target 34.

The detector electronics include a photomultiplier tube 45 coupled to the sodium iodide scintillator 52 and disposed within lead shielding 42. The remaining portion of the electronics and data acquisition system 50 is coupled to the photomultiplier tube 45 by means of an electrical lead 48 extending through a narrow second slot 46 within lead shielding 42. The electronics and data acquisition system 50 is conventional in design and operation and includes a preamplifier, a high voltage power supply, an amplifier, a delay amplifier, a pulse selector, and a linear gate, which are not shown in the figure for simplicity. The latter three components allow pulses below an equivalent photon energy of 2.506 MeV to be rejected. Signals corresponding to higher energy gamma rays were acquired on line with a computer, although it would have been possible to alternatively record data using either a multichannel analyzer or a scaler. Object 34 was scanned in the direction of arrow 40 by the incident gamma rays 32 by displacing the object in the direction of the arrow.

Figure 3:
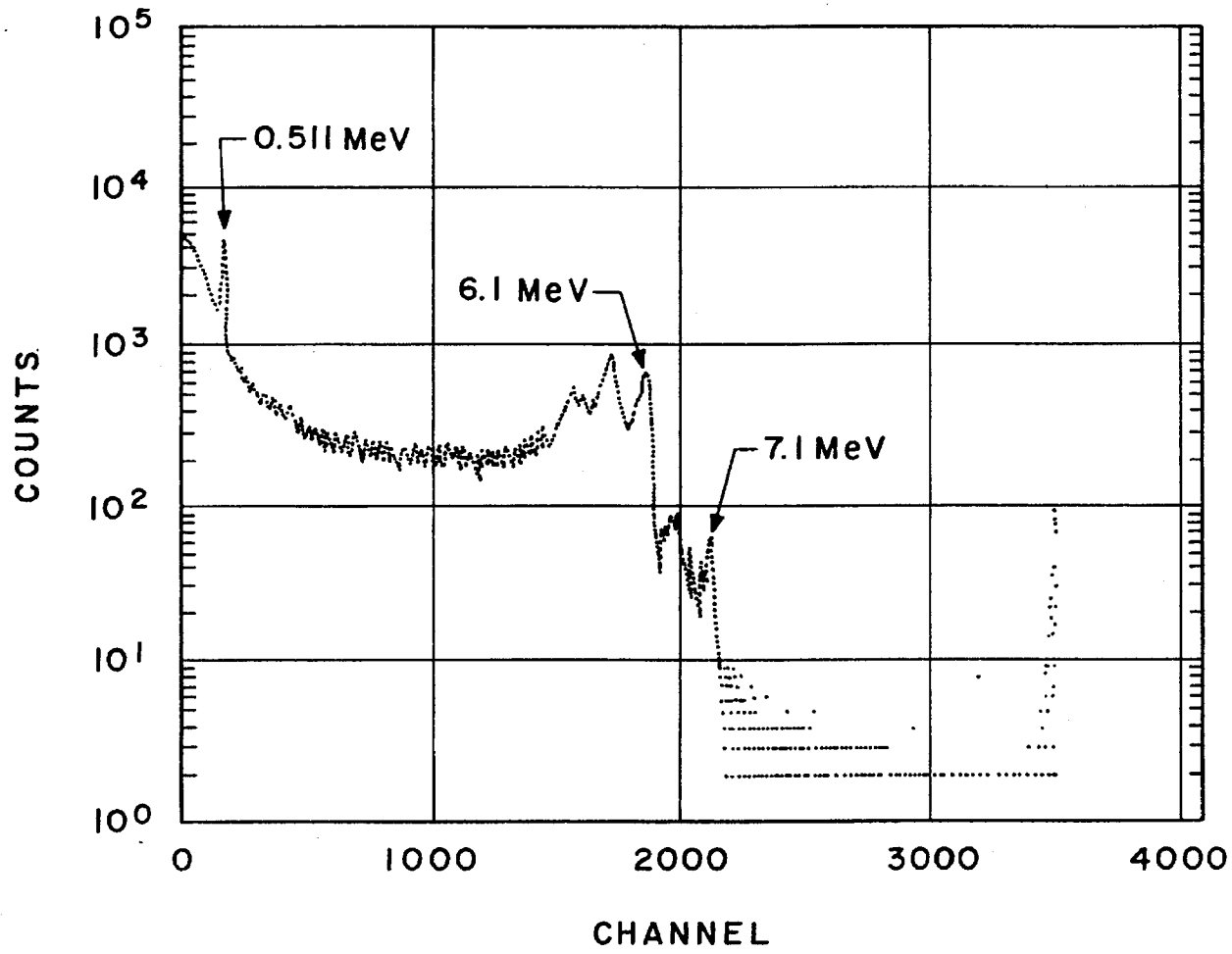
FIG. 3 is a graphic representation of a typical spectrum of gamma rays from $^{16}N$ recorded with a sodium iodide scintillation detector and associated electronics instrumentation for pulse height analysis.

FIG. 3 is a graphic representation of a typical sodium iodide scintillation detector spectrum produced by 6.129+7.115 MeV gamma rays from radioactive water produced in accordance with the present invention, as seen by the shielded scintillation detector 36 through the above-described collimator system without an intervening object 34 present.

Figure 4A:
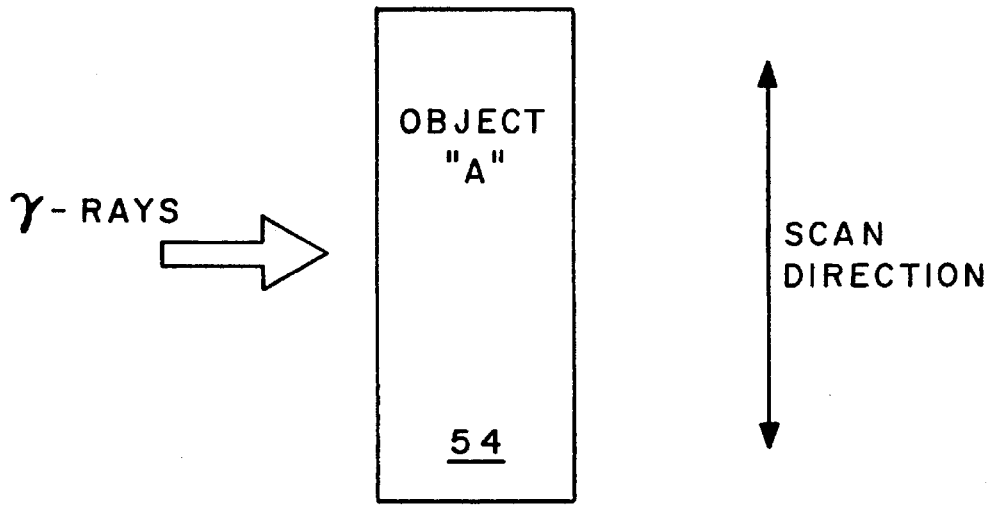
FIGS. 4*a* and 4*b* are respectively simplified schematic end and side views of the manner in which an object may be investigated using the radiography apparatus of the present invention.
Figure 4B:
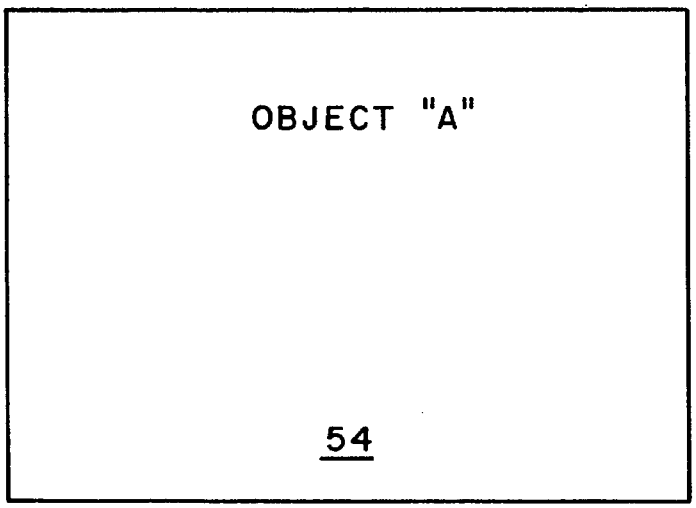
Figure 5A:
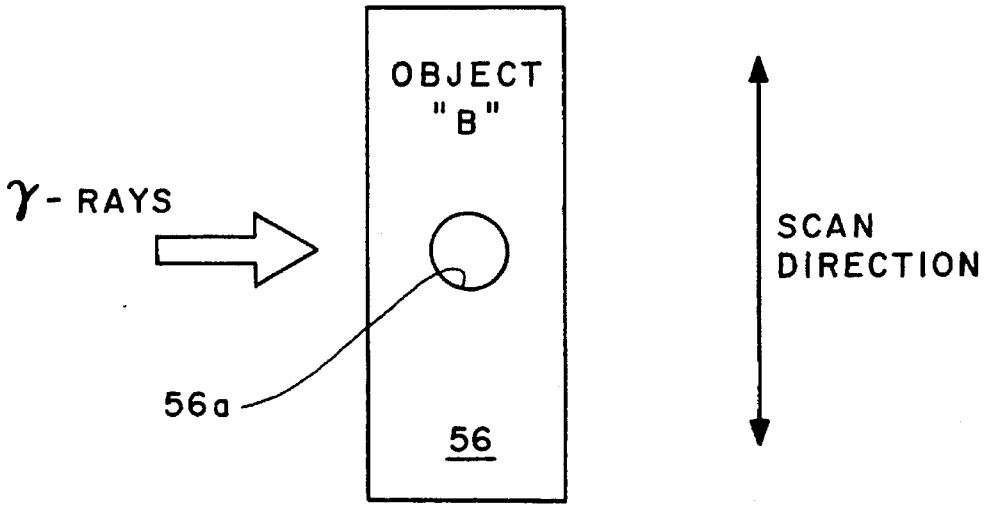
FIGS. 5*a* and 5*b* are respectively simplified schematic end and side views of another approach for investigating an object in accordance with another aspect of the present invention.
Figure 5B:
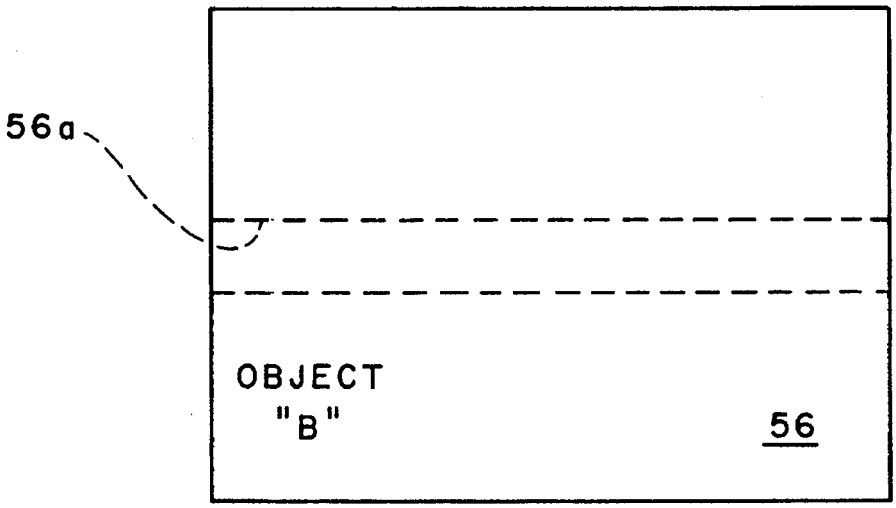
Figure 6A:
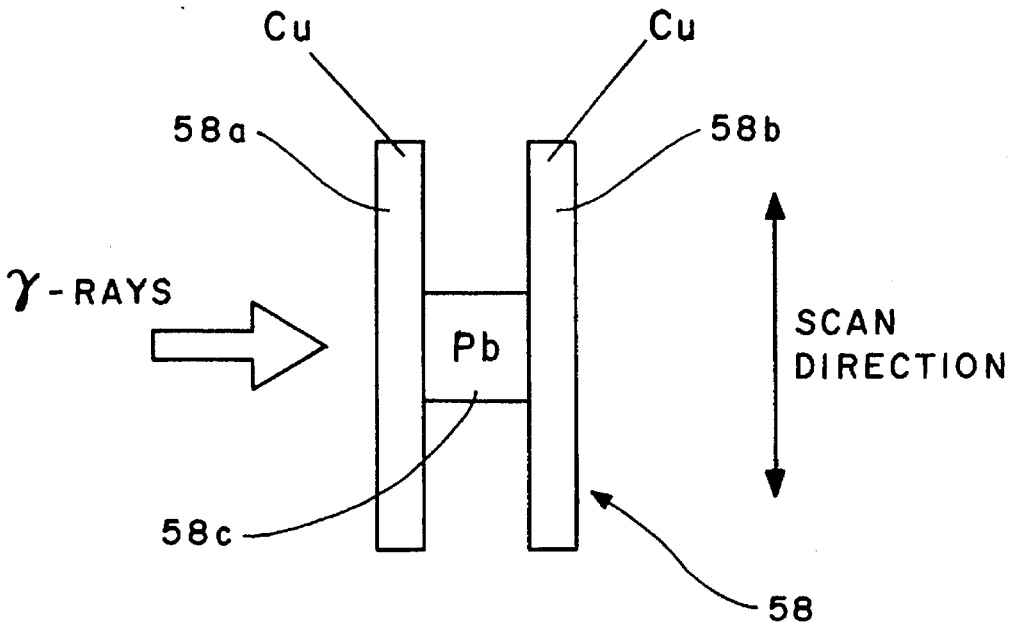
FIGS. 6*a* and 6*b* are respectively simplified schematic end and side views of yet another approach for investigating an object in accordance with yet another aspect of the present invention.
Figure 6B:
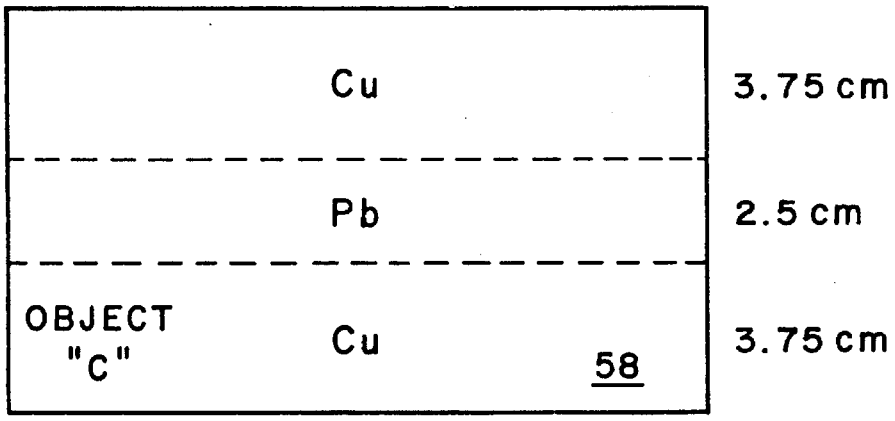
Figure 7A:
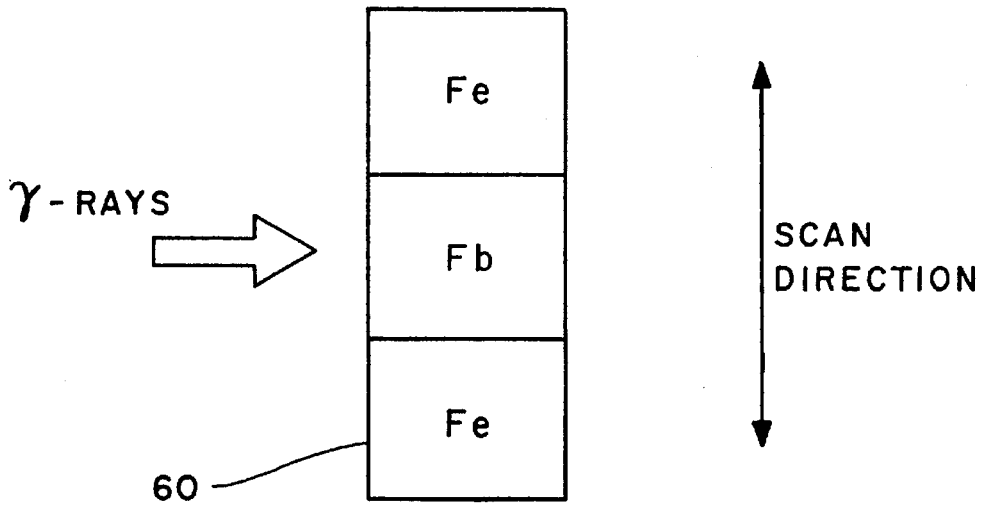
FIGS. 7*a* and 7*b* are respectively simplified schematic end and side views of still another approach for investigating an object in accordance with yet another aspect of the present invention.
Figure 7B:
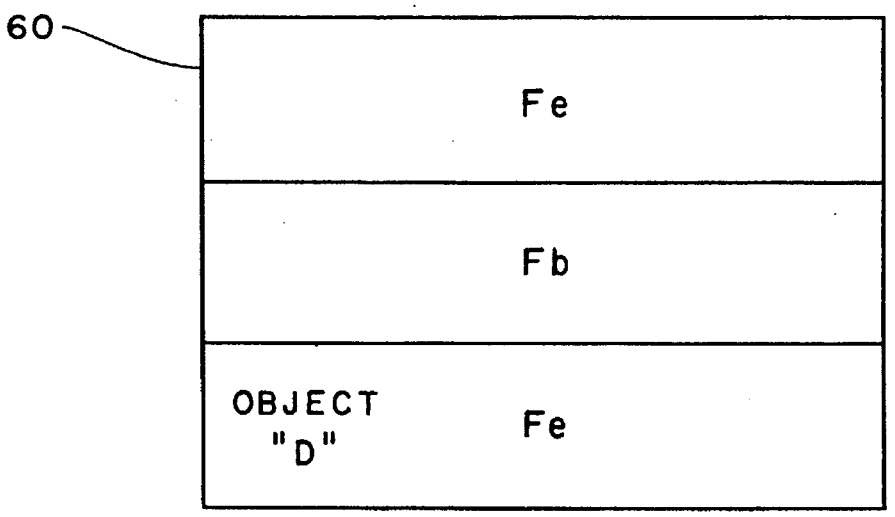

Four test objects were prepared for use in demonstrating the feasibility of performing radiographic studies with the radiography apparatus of the present invention. Object A 54 as shown in FIGS. 4*a* and 4*b* is a featureless, 5 cm×15 cm×20 cm rectangular block of stainless steel (mostly iron). Object B 56 shown in FIGS. 5*a* and 5*b* is identical to Object A except for a 2 cm diameter hole drilled through the center along its axis. Object C 58 shown in the end and side views of FIGS. 6*a* and 6*b* consists of two 1 cm-thick copper plates 58*a* and 58*b* with a hidden rectangular lead block 58*c* which is 2.5 cm×20 cm situated between the two copper plates. Object D 60 shown in the end and side views of FIGS. 7*a* and 7*b* consists of two 5 cm×5 cm×20 cm stainless steel blocks and one pure lead block of the same dimensions stacked together. Each of objects "A" "B" "C" and "D" was scanned in the collimated photon beam, typically in steps of 0.5 cm, across a range of about 10 cm that fully encompassed the features of the object. Measurements were made periodically without an object in place (100% transmission). A gamma ray spectrum was recorded at each position. A fission chamber located near the accelerator target was used to measure the accumulated neutron output from the accelerator during each measurement interval. The intensity of $^{16}N$ decay photons available for radiography is directly proportional to the neutron field intensity for a steady-state condition of water flow in the system. These recorded neutron fluence data were used to normalize each photon transmission measurement. The exposure times for each sample position were generally about 5 minutes. Therefore, it took about an hour to scan each individual object and thereby generate the desired radiograph which displayed its characteristic features.

Additional measurements were performed at various times in carrying out the present invention to determine the extent and origin of the background. One such set of measurements was made for a 10 cm-thick lead brick blocking the collimator that defined the photon source. Spectral data was also acquired with the water turned off (so that no $^{16}N$ activity was transported from the target area to the radiography apparatus) and with the FNS accelerator turned off to determine ambient and cosmic ray background. These measurements showed that the signal-to-noise ratio for the arrangement used in the present invention was about 20-to-1, and that a significant portion of the background came from ambient sources and cosmic ray interactions. It was also found that there was little change in the shape of the spectrum produced by the $^{16}N$ gamma rays when various objects were placed between the gamma ray source and detector for radiography investigation. In other words, although the spectrum yield was reduced, the actual appearance of the spectrum was not noticeably distorted by passage of the gamma rays through the various materials considered. This result served to indicate that most of the detected gamma rays were either primary ones or those which inexperienced at most only small angle scattering interactions that did not significantly alter their energies.

The events recorded in each spectrum produced by the sodium iodide scintillation detector 52 were summed from just above the lower level cutoff defined by the pulse selector and linear gate to just below the position where the amplifier saturated. These spectral sums constituted the raw transmission data. It was not necessary to calibrate the response of the detector any further. This approach to the analysis of these experimental data was possible because the shape of the spectrum was not noticeably altered by the passage of photons through the studied objects. The summed counts were corrected for recording dead time, and were further adjusted for neutron exposure of the water, to yield values of relative transmitted photon intensity. The relative integrated neutron fluence for each measurement time interval was deduced from the output of a fission chamber neutron monitor as discussed above. Periodic measurements of gamma ray spectra with no object present defined the equivalent incident photon intensity $I_o$ so that meaningful transmission ratios $I/I_o$ could be calculated. One dimensional radiographs for the various investigated objects were constructed from these ratios.

Referring to FIGS. 8*a*–8*d*, there are shown graphic results of one-dimensional photon scans of the objects respectively shown in FIGS. 4*a*, 4*b*; 5*a*, 5*b*; 6*a*, 6*b*; and 7*a*, 7*b*, as measured and recorded by the present invention. The indicated uncertainties are based on the combined statistics for the summed counts from the sodium iodide scintillation detector spectra and for the neutron fluence monitor counts. The data points are connected with solid lines to provide eye guides. The dotted line segments indicate values of the transmissions which were calculated using the exponential law equation for the transmission of photons through matter, in combination with photon cross sections and pertinent material parameters. Qualitative agreement is observed in regions where the transmission is "flat" versus scan distance. However, precise agreement should not be expected because of uncertainties in density, thickness and composition of the materials involved, and the effects of small angle photon scattering. As indicated above, most of the data were acquired in increments of 0.5 cm along the scanning direction. Scanning was accomplished by moving the investigated object past the fixed collimator system in the direction of the scanning arrows shown in the aforementioned figures. It is clear from the data presented that the spatial resolution observed for these radiographs is consistent with the dimensions of the collimator arrangement.

Figure 8A:
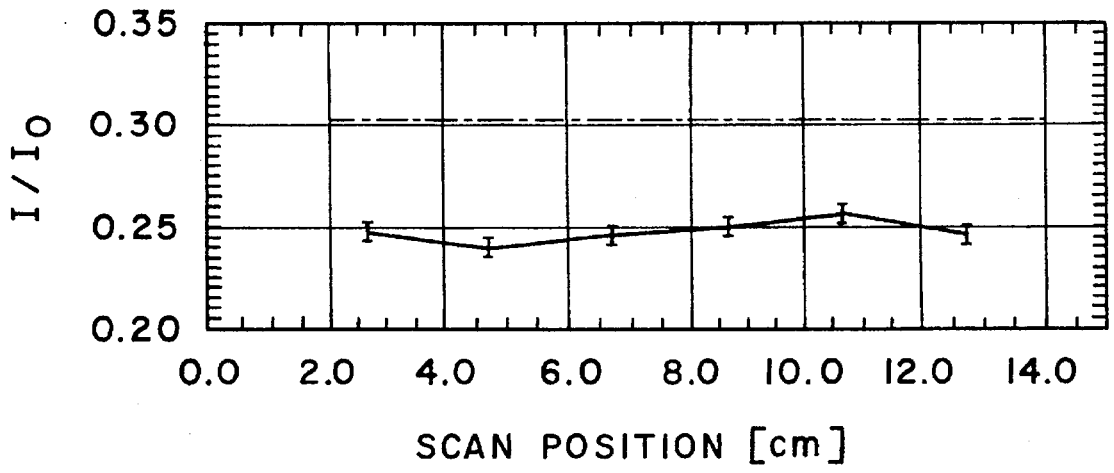
FIGS. 8*a*–8*d* are the graphic results of one-dimensional photon scans of the objects respectively shown in FIGS. 4*a*, 4*b*; 5*a*, 5*b*; 6*a*, 6*b*; and 7*a*, 7*b*.
Figure 8B:
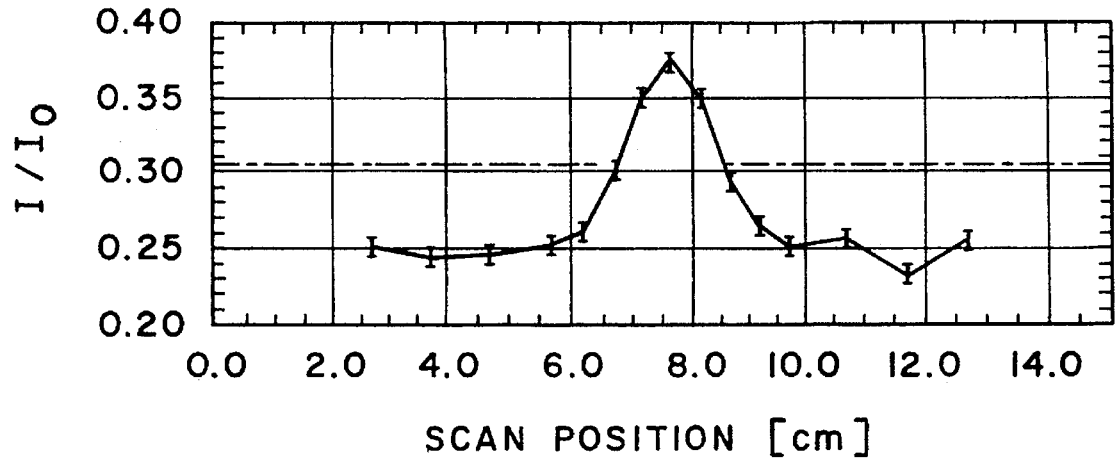
Figure 8C:
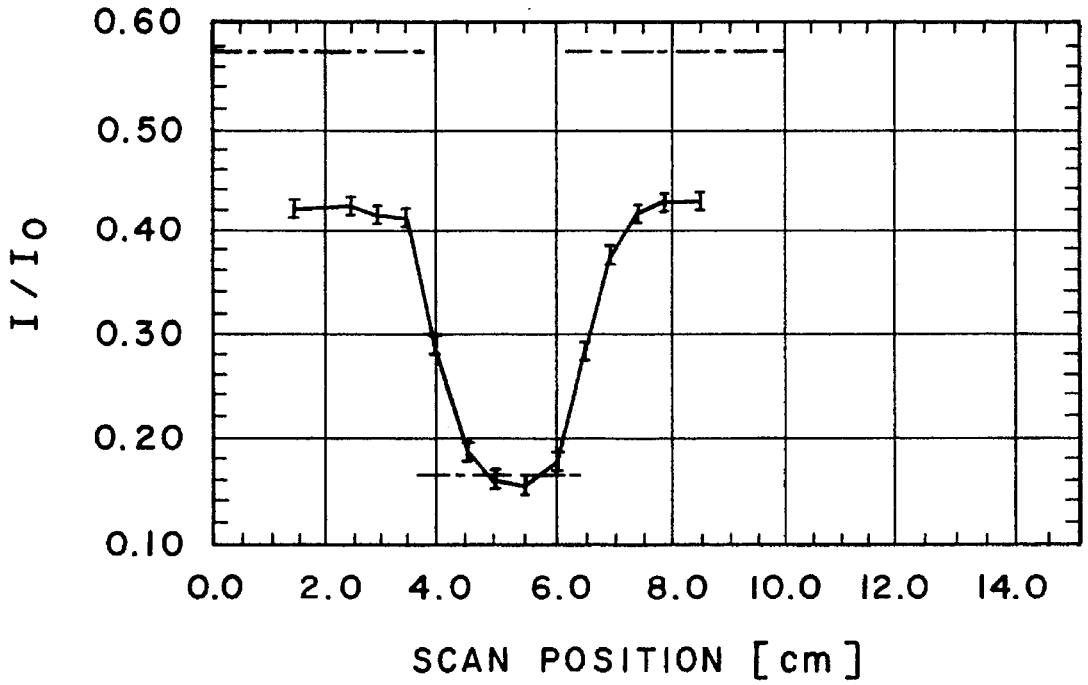
Figure 8D:
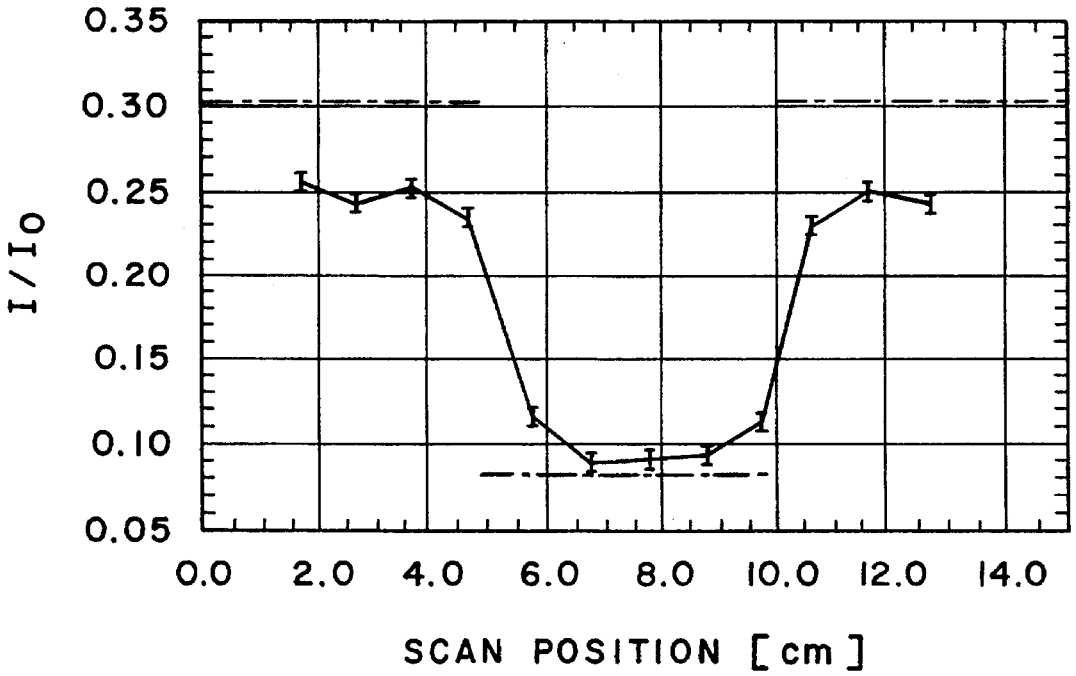

The graphic representations shown in FIGS. 8*a*–8*d* provide evidence of the individual features of the investigated objects shown in FIGS. 4*a*, 4*b* through 7*a*, 7*b*. For example, FIG. 8*a* shows object "A" as uniform with no distinguishing features as is evident from the featureless one-dimensional radiograph of this figure The hidden hole in object "B" shown in FIGS. 5*a*, 5*b* is apparent from the large peak in FIG. 8*b*. Similarly, the lead block hidden between the two copper plates in object "C" as shown in FIGS. 6*a*, 6*b* appears as the large trough in the graphic representation of FIG. 8*c*. Finally, the iron-lead-iron discontinuity characterizing object "D" shown in FIGS. 7*a*, 7*b* appears as the deep trough in the graphic representation of FIG. 8*d*.

The collimator geometry of the radiography apparatus 10 of the present invention shown in FIGS. 1 and 2 could be modified to provide improved resolution if the coupling of the circulating loop of water 12 to the neutron radiation field from the neutron source 15 were optimized. For example, with a factor of two orders of magnitude ($10^2$) enhancement in gamma ray source strength, which should be quite feasible at the FNS facility, it would be possible to reduce the collimator dimensions to 0.5 cm×0.5 cm and still achieve the same statistical precision in the transmission data for exposures of equivalent duration. Two dimensional scans would be feasible using such a rectangular collimator, but an array of several small detectors would be necessary to permit radiographs to be generated in a more reasonable time than would be required for a single large detector arrangement. These changes could be implemented by simple engineering design revisions and would not involve changes in the fundamental principles of the present invention.

There is a difference of about seven orders of magnitude ($10^7$) in the photon intensity observed from the radioactive water produced in the present invention and that which is likely to be encountered with the cooling water exiting from a D-T fusion reactor such as the International Thermonuclear Experimental Reactor (ITER). With such enhanced gamma ray source strengths at a D-T fusion reactor facility, it would be possible to achieve much better resolution and far shorter exposure times than appears to be possible with any existing D-T neutron generator. Resolution on the order of 1 mm and exposures no longer than a few seconds could be easily obtained, even allowing for some reduction in the gamma ray source strength due to the time required to transport water from a D-T fusion reactor to the remote location where radiography is performed. Since the volume of radioactive water available would be very large, it would also be possible employing a continuous, extended sheet of radioactive water and a two-dimensional array of collimators and detectors to obtain a complete radiographic image of a large, complex object in a matter of a few seconds.

There has thus been shown a radiography apparatus for producing and directing essentially monoenergetic gamma rays onto an object for radiographic analysis. The substantial penetrating power of the monoenergetic gamma rays allows for accurate determination of the thickness of an object under investigation as well as its elemental composition, particularly for metals and high atomic number materials. The monoenergetic gamma rays are generated by exposing a circulating loop of water to energetic neutrons which may be produced by irradiating a tritium target with a deuteron beam such as obtained from a D-T fusion neutron generator. Oxygen in the pure water in the circulating loop is activated via the $^{16}O(n,p)^{16}N$ reaction using 14-MeV neutrons produced at the neutron source via the $^{3}H(d,n)^{4}He$ reaction. The object to be analyzed is located at a remote location to which the water circulating in the loop flows. The characteristic decay half life of 7.13 seconds is sufficient to permit gamma ray generation at a remote location, while not presenting a chemical or radioactivity hazard because the radioactivity falls to negligible levels after one-two minutes.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. Radiography apparatus for determining the composition and/or thickness of a solid object, said apparatus comprising:

a circulating system of water;

a source of energetic neutrons located adjacent a first portion of said circulating water system for directing said energetic neutrons onto the water and activating oxygen in the water to a radioactive state, followed by decay of the activated water by the emission of substantially monoenergetic gamma rays;

collimator means disposed adjacent a second, remote portion of said circulating water system for directing a beam of said gamma rays onto an object; and photodetector means disposed adjacent said second, remote portion of said circulating system of water for receiving said gamma rays after transitting the object for analyzing the composition and/or thickness of the object.

2. The apparatus of claim 1 wherein said source of energetic neutrons includes a tritium target responsive to energetic deuterons incident thereon.

3. The apparatus of claim 2 wherein said tritium target is of a titanium-tritide composition.

4. The apparatus of claim 2 further comprising a source of energetic deuterons including a deuterium-tritium fusion reactor.

5. The apparatus of claim i wherein the oxygen in the water is activated by the reaction $^{16}O(n,p)^{16}N$ reaction for providing 14-MeV neutrons.

6. The apparatus of claim 1 wherein said circulating system of water includes a variable pump for varying the intensity of the gamma rays.

7. The apparatus of claim 6 wherein said circulating system is in the form of a closed loop and includes a flow meter for measuring water flow rate.

8. The apparatus of claim 1 further comprising a lead shield disposed about the second, remote portion of said circulating system of water, and wherein said collimator means includes a rectangular slot disposed in said lead shield in facing relation to the object.

9. The apparatus of claim 1 further comprising displacement means coupled to the object for moving the object relative to said source of energetic gamma rays and scanning said energetic gamma rays over the object.

10. The apparatus of claim 1 wherein said photodetector means includes a shielded sodium iodide scintillator.

11. The apparatus of claim 1 wherein said circulating system of water includes plastic tubing for passing water adjacent to said source of energetic neutrons.

12. The apparatus of claim 1 further comprising means for rendering said photodetector means insensitive to gamma rays less than a predetermined threshold energy level for reducing background noise and improving signal-to-noise ratio.

13. A method for analyzing the composition and/or thickness of a solid object, said method comprising the steps of:

circulating water in a closed loop;

generating and directing energetic neutrons onto the circulating water in a first portion of said closed loop for activating oxygen in the water to a radioactive state, followed by decay of the activated oxygen by the emission of substantially monoenergetic gamma rays;

forming the emitted gamma rays into a beam at a second, remote location in said closed loop;

directing the gamma ray beam onto the solid object; and detecting the gamma rays after transitting the object for analyzing the composition and/or thickness of the object.

14. The method of claim 13 wherein the step of generating and directing energetic neutrons onto the circulating water includes generating and directing energetic deuterons onto a tritium target.

15. The method of claim 14 wherein the step of generating and directing energetic deuterons onto a tritium target includes directing the deuterons from a deuterium-tritium fusion reactor onto tritium in a D-T plasma environment.

16. The method of claim 13 wherein the step of forming the emitted gamma rays into a beam includes directing the emitted gamma rays through a rectangular slot.

17. The method of claim 13 further comprising the step of displacing the object while the gamma ray beam is incident thereon for scanning the gamma ray beam over the object.

18. The method of claim 13 further comprising the step of varying the flow rate of the circulating water in the closed loop for changing the intensity of the gamma ray beam.

19. The method of claim 13 further comprising the step of cutting off gamma rays having less than a predetermined threshold energy level from detection for reducing background noise and improving signal-to-noise ratio.

* * * * *